US011027553B2

(12) United States Patent
Hsieh

(10) Patent No.: US 11,027,553 B2
(45) Date of Patent: Jun. 8, 2021

(54) CONNECTOR STRUCTURE OF INK POUCH

(71) Applicant: TAIWAN NANOTECHNOLOGY CORPORATION, Taichung (TW)

(72) Inventor: Cheng-Yang Hsieh, Taichung (TW)

(73) Assignee: TAIWAN NANOTECHNOLOGY CORPORATION, Taichung (TW)

( * ) Notice: Subject to any disclaimer, the term of this patent is extended or adjusted under 35 U.S.C. 154(b) by 0 days.

(21) Appl. No.: 16/823,292

(22) Filed: Mar. 18, 2020

(65) Prior Publication Data

US 2020/0331274 A1 Oct. 22, 2020

(30) Foreign Application Priority Data

Apr. 18, 2019 (TW) ..... 108113669

(51) Int. Cl.
*B41J 2/175* (2006.01)

(52) U.S. Cl.
CPC ..... *B41J 2/1754* (2013.01); *B41J 2/17503* (2013.01); *B41J 2/17506* (2013.01); *B41J 2/17513* (2013.01); *B41J 2/17523* (2013.01); *B41J 2002/17516* (2013.01)

(58) Field of Classification Search
CPC .... B41J 2/175; B41J 2/17503; B41J 2/17506; B41J 2/17513; B41J 2/17523; B41J 2/1754; B41J 2002/17516; B65D 75/5883; B43L 27/04; B43L 25/007
See application file for complete search history.

(56) References Cited

U.S. PATENT DOCUMENTS 5,227,139 A * 7/1993 Wong ..... B01L 3/50825 215/349
7,493,808 B2 * 2/2009 Milanovich ..... B60C 23/0496 116/34 R
2004/0055661 A1 * 3/2004 Yuen ..... B43L 25/007 141/2
2004/0161504 A1 * 8/2004 Daniels ..... A23L 2/52 426/115

* cited by examiner

*Primary Examiner* — Anh T Vo
(74) *Attorney, Agent, or Firm* — Leong C. Lei

(57) ABSTRACT

A connector structure of an ink pouch includes a connector body including a joining section, a sealing section, and an ink passage extending through the joining section and the sealing section, the sealing section having a hollow fitting peg, insertion slots, and an annular retaining groove in communication with the insertion slots; a sealing cap including a pressing section and a fitting trough corresponding in position to the pressing section and engaging and retaining sections, each of which has an insertion arm and an engaging block protruding from the insertion arm; and a flexible plug. To combine, the flexible plug is positioned in the fitting trough and the insertion arms of the engaging and retaining sections are inserted into the insertion slots to have the engaging blocks protrude into the annular retaining groove. The fitting peg is received in the fitting trough and the flexible plug closes the ink passage.

6 Claims, 8 Drawing Sheets

CONNECTOR STRUCTURE OF INK POUCH

TECHNICAL FIELD OF THE INVENTION

The present invention relates to an ink pouch, and more particularly to a connector structure of an ink pouch.

DESCRIPTION OF THE PRIOR ART

The term "ink pouch" as used here refers to a pouch or a bag or a flexible container that receives and holds an amount of ink in an interior space thereof and is directly connectable to a printer or is mountable in an ink cartridge to supply ink to a printer.

An early-day ink pouch was structured to include a rubber plug in an ink channel. The rubber plug is readily movable due to an external force acting thereon and consequently, leaking of ink occurs.

Taiwan Patent No. I462841 discloses an ink pouch connector structure 1, which effectively overcomes the issue of ink leaking, wherein as shown in FIG. 1, two injection molding operations are carried out to first forming an enclosing arrangement of a connector 2 and a flexible rubber material 3, and then to have the connector 2 bonded to a pouch body 4. Such a process of two injection molding operations is effective in achieving desired sealing, yet such a structure requires the connector 2 and the pouch body 4 be first bonded and sealed through application of high frequency waves, and then ink is filled into the pouch body 4 through a bottom 41 of the pouch, and afterwards, the bottom of the pouch body 4 is subjected to high-frequency bonding. As such, the amount of ink filled in the pouch body 4 cannot be made fixed, and it also happens that a high temperature caused by the high-frequency bonding changes the quality of the ink. Further, such a process of two injection molding operations is carried out with specific machinery and molds and this increases the cost of fabrication.

SUMMARY OF THE INVENTION

In view of the above, in order to overcome the drawbacks of the known techniques that a known connector structure of an ink pouch suffers being difficult to set a predetermined amount of ink filled therein, ink filled therein being ready to change quality, and fabrication cost being high, the present invention provides a connector structure of an ink pouch, which generally comprises: a connector body, which comprises a joining section, a sealing section joined to the joining section, and an ink passage extending in a longitudinal direction through the joining section and the sealing section, the sealing section having a top surface on which a fitting peg, which is hollow, is formed to extend upward from a circumference of the ink passage, the top surface of the sealing section being formed with a plurality of insertion slots that are extended downward and spaced from each other along a circumference of the fitting peg by a predetermined interval, the sealing section having an external circumferential surface that is partly and inwardly recessed to form an annular retaining groove, the annular retaining groove being in communication with ends of the plurality of the insertion slots; a sealing cap having a top surface that is partly recessed downward in a central portion thereof to form a pressing section, the sealing cap having a bottom surface that is partly recessed upward to form a fitting trough corresponding in position to the pressing section, the bottom surface of the sealing cap being provided with a plurality of engaging and retaining sections projecting therefrom and along a circumference of the fitting trough and spaced from each other by a predetermined interval, the engaging and retaining sections each comprising an insertion arm extending downward from the bottom surface of the sealing cap and an engaging block protruding outward from an end of the insertion arm; and a flexible plug having an outside diameter that is greater than an inside diameter of the ink passage of the connector body. To combine, the flexible plug is positioned in the fitting trough of the sealing cap, and the insertion arms of the engaging and retaining sections of the sealing cap are respectively inserted into the insertion slots of the connector body, such that the engaging blocks protrude into the annular retaining groove of the connector body to securely combine the sealing cap and the connector body together. The fitting peg is located in the fitting trough and the flexible plug closes the ink passage. As such, the present invention provides effects of being securely and tightly combined to prevent leaking, enabling filling of ink of a fixed amount, protecting ink from quality variation resulting from heating, enabling easy fabrication, lowering costs, and having enhanced market competition power.

DETAILED DESCRIPTION OF THE PREFERRED EMBODIMENT

Figure 1:
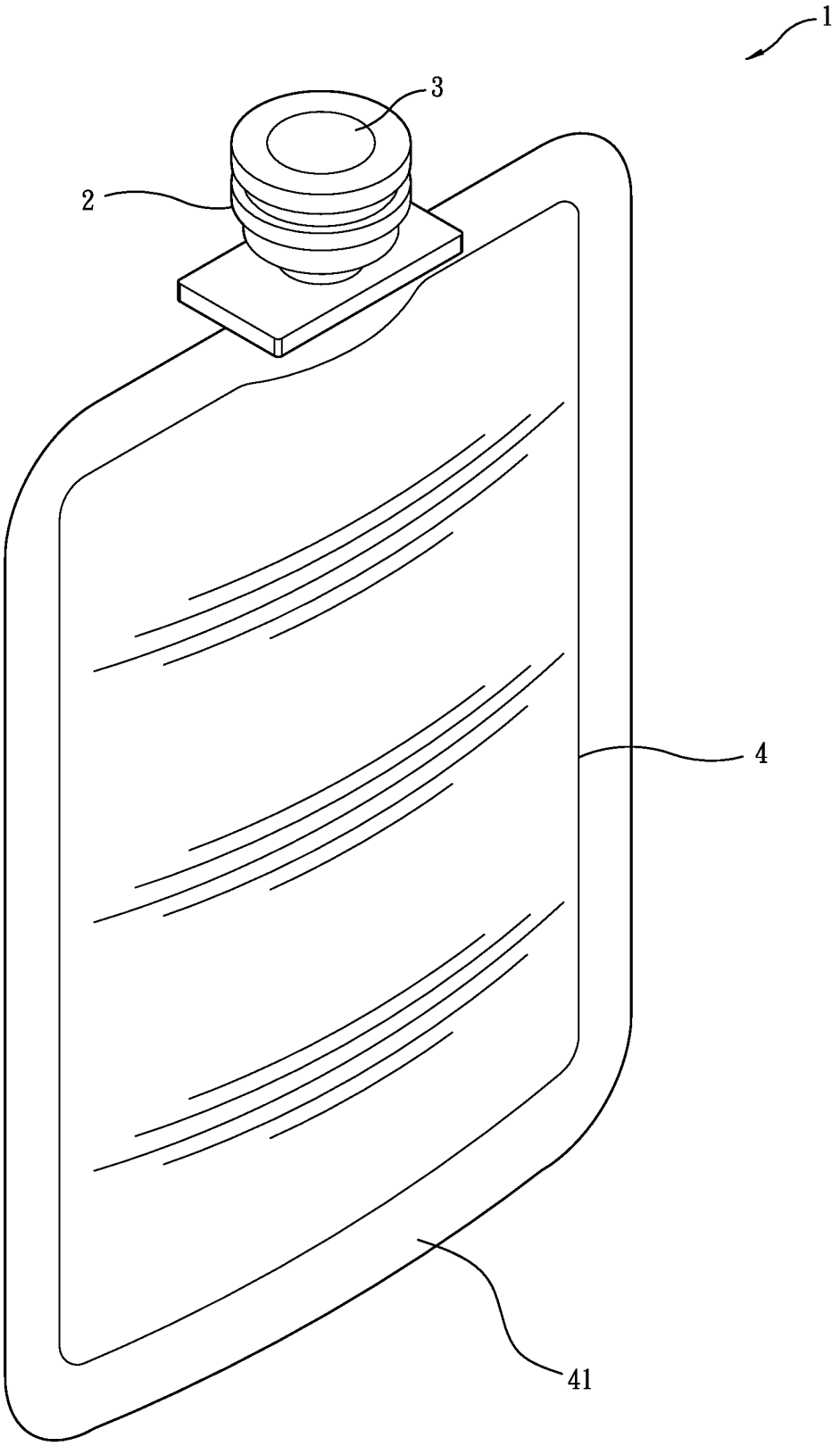
PRIOR ART FIG. 1
FIG. 1 is a perspective view showing a known ink pouch connector structure.

Referring to FIGS. 2-8, a preferred embodiment of the present invention is shown, providing a connector structure 100 of an ink pouch, generally comprising a connector body 10, a flexible plug 20, a sealing cap 30, a first sealing ring 40, and a second sealing ring 50.

Figure 2:
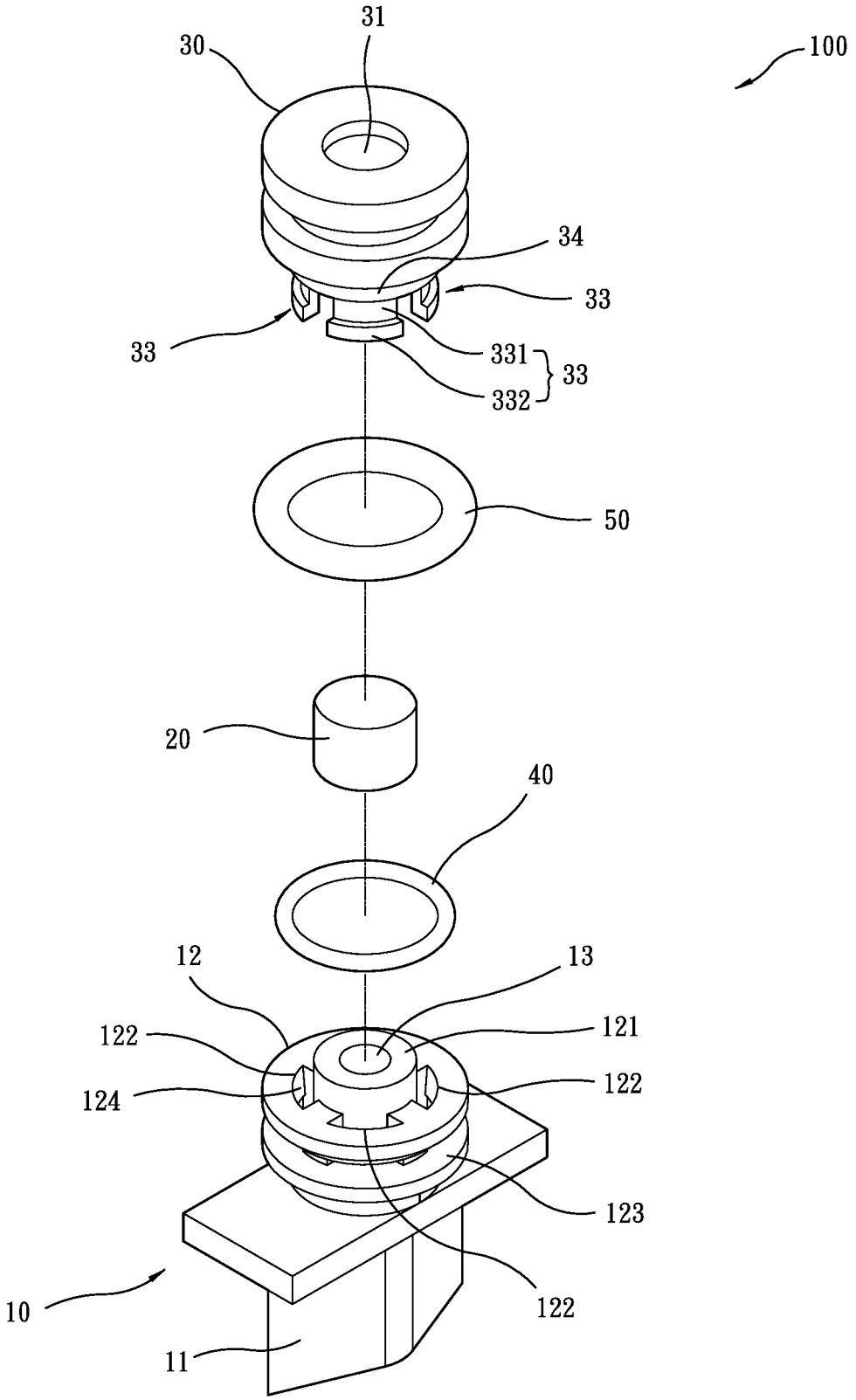
FIG. 2 is an exploded view showing a preferred embodiment of the present invention.
Figure 3:
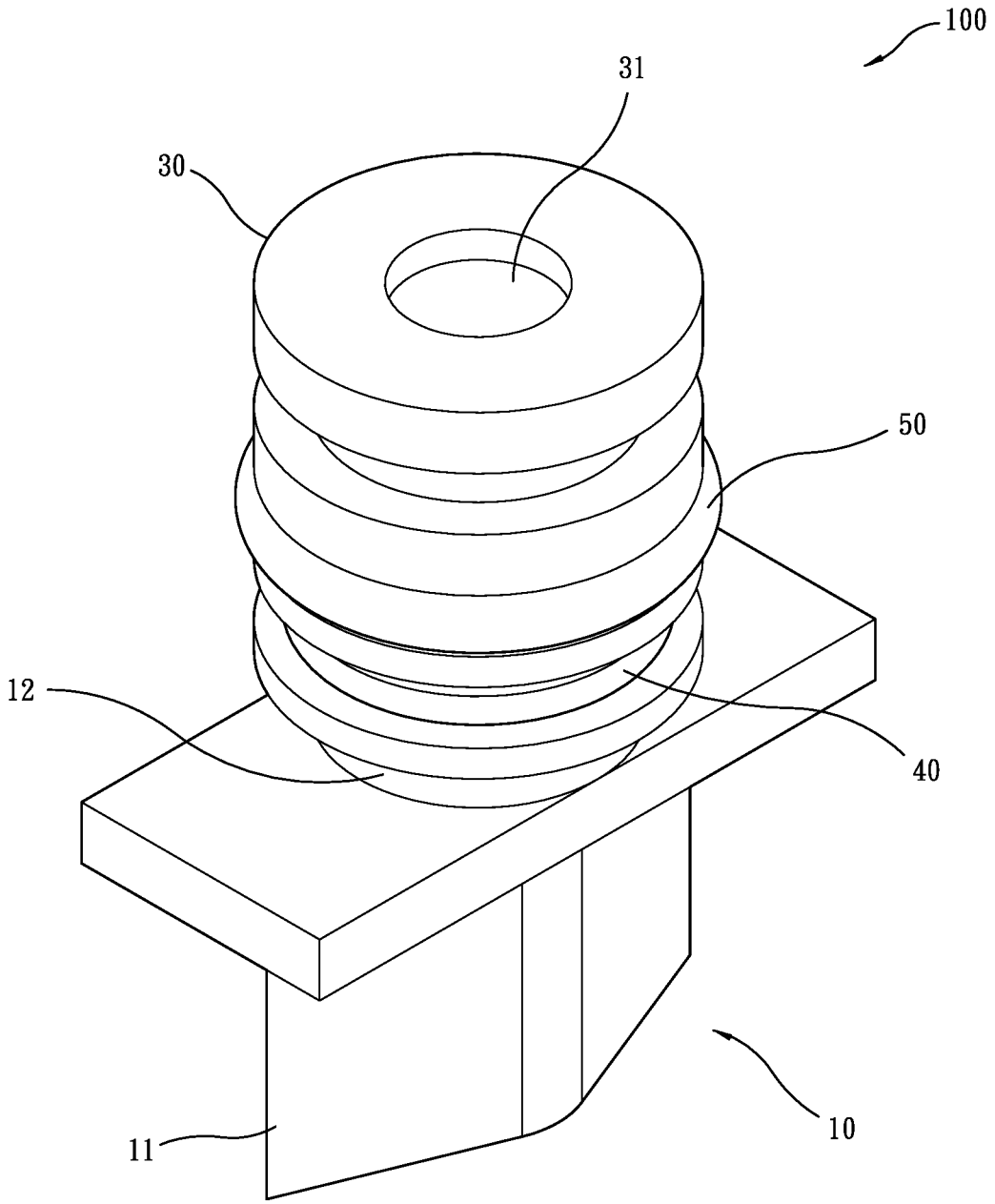
FIG. 3 is a perspective view showing the embodiment of FIG. 2 in an assembled form.
Figure 4:
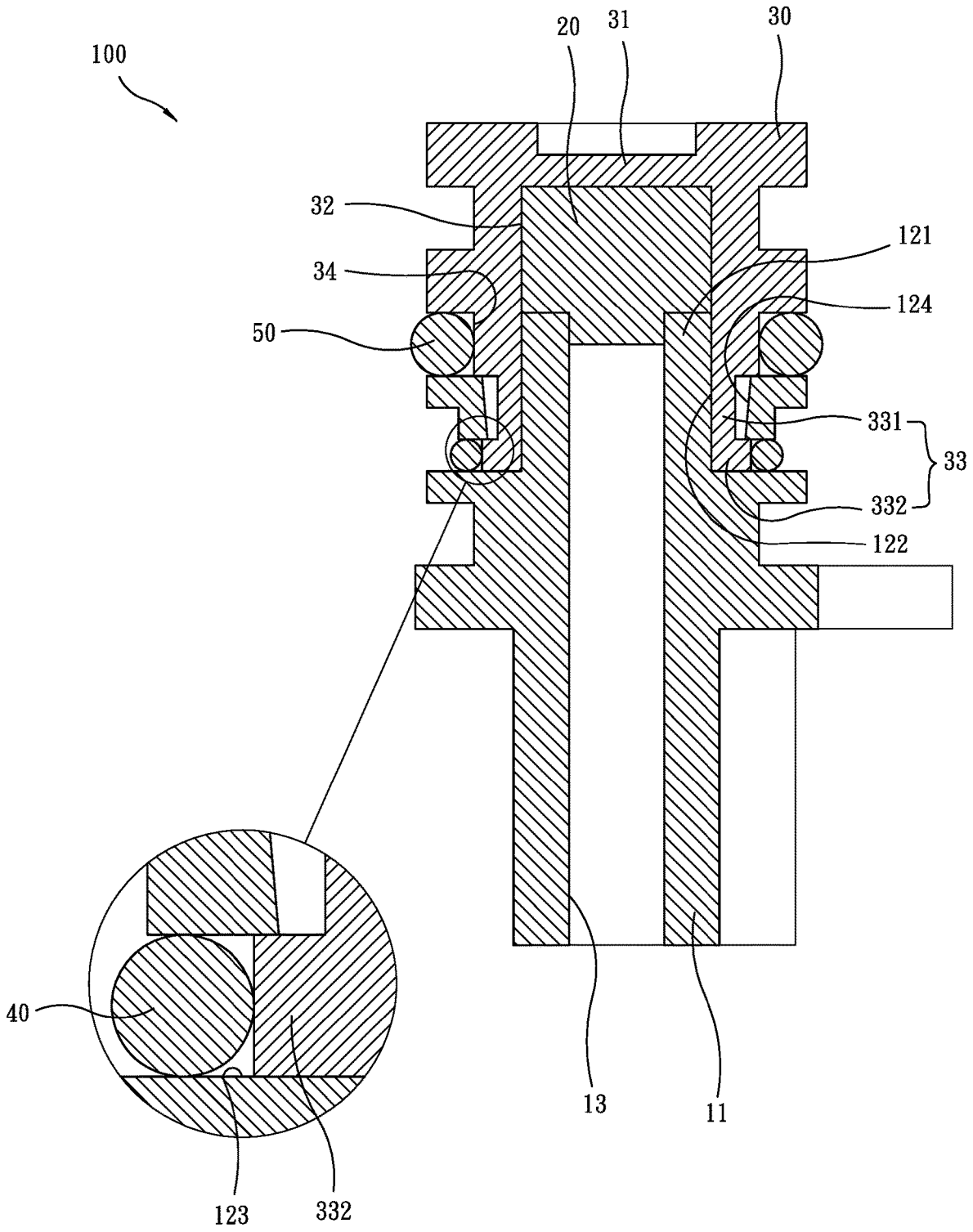
FIG. 4 is a cross-sectional view showing the embodiment of FIG. 2 in an assembled form, in which a circled portion is additionally shown in an enlarged way.

Referring to FIGS. 2-4, the connector body 10 is integrally formed of plastics. The connector body 10 includes a joining section 11, a sealing section 12 integrally combined with the joining section 11, and an ink passage 13 extending in a longitudinal direction through the joining section 11 and the sealing section 12. The joining section 11 is provided for connection with and combined with a pouch body. The sealing section 12 is generally of a cylindrical configuration. The sealing section 12 has a top surface on which a fitting peg 121, which is hollow, is formed to extend upward from a circumference of the ink passage 13. The top surface of the sealing section 12 is formed with a plurality of insertion slots 122 that are extended downward and spaced from each other along a circumference of the fitting peg 121 by a predetermined interval. The sealing section 12 has an external circumferential surface that is partly and inwardly recessed to form an annular retaining groove 123, such that the annular retaining groove 123 is in communication with ends of the plurality of the insertion slots 122. Each of the insertion slots 122 has a side that forms an inclined wall 124 arranged to have a diameter defined by the slot side gradually reduced or converged in a direction from a top end to a bottom end.

Referring to FIGS. 2-4, the flexible plug 20 is generally of a cylindrical form and is made of a material that is softer than the materials that make the connector body 10 and the sealing cap 30. The flexible plug 20 has an outside diameter that is greater than an inside diameter of the ink passage 13 of the connector body 10.

Referring to FIGS. 2-4, the sealing cap 30 is integrally formed of plastics. The sealing cap 30 has a top surface that is partly recessed downward in a central portion thereof to form a pressing section 31. The sealing cap 30 has a bottom surface that is partly recessed upward to form a fitting trough 32 corresponding in position to the pressing section 31. The bottom surface of the sealing cap 30 is provided with a plurality of engaging and retaining sections 33 projecting therefrom and along a circumference of the fitting trough 32 and spaced from each other by a predetermined interval. The engaging and retaining sections 33 each include an insertion arm 331 extending downward from the bottom surface of the sealing cap 30 and an engaging block 332 protruding outward from an end of the insertion arm 331. The sealing cap 30 is formed, in an outer circumferential surface thereof adjacent to the engaging and retaining sections 33, with an annular sealing groove 34.

The above provides an introduction to parts and components of the connector structure 100 of an ink pouch according to the preferred embodiment of the present invention, and in the following features of operation and assembling of the present invention will be described.

Figure 5:
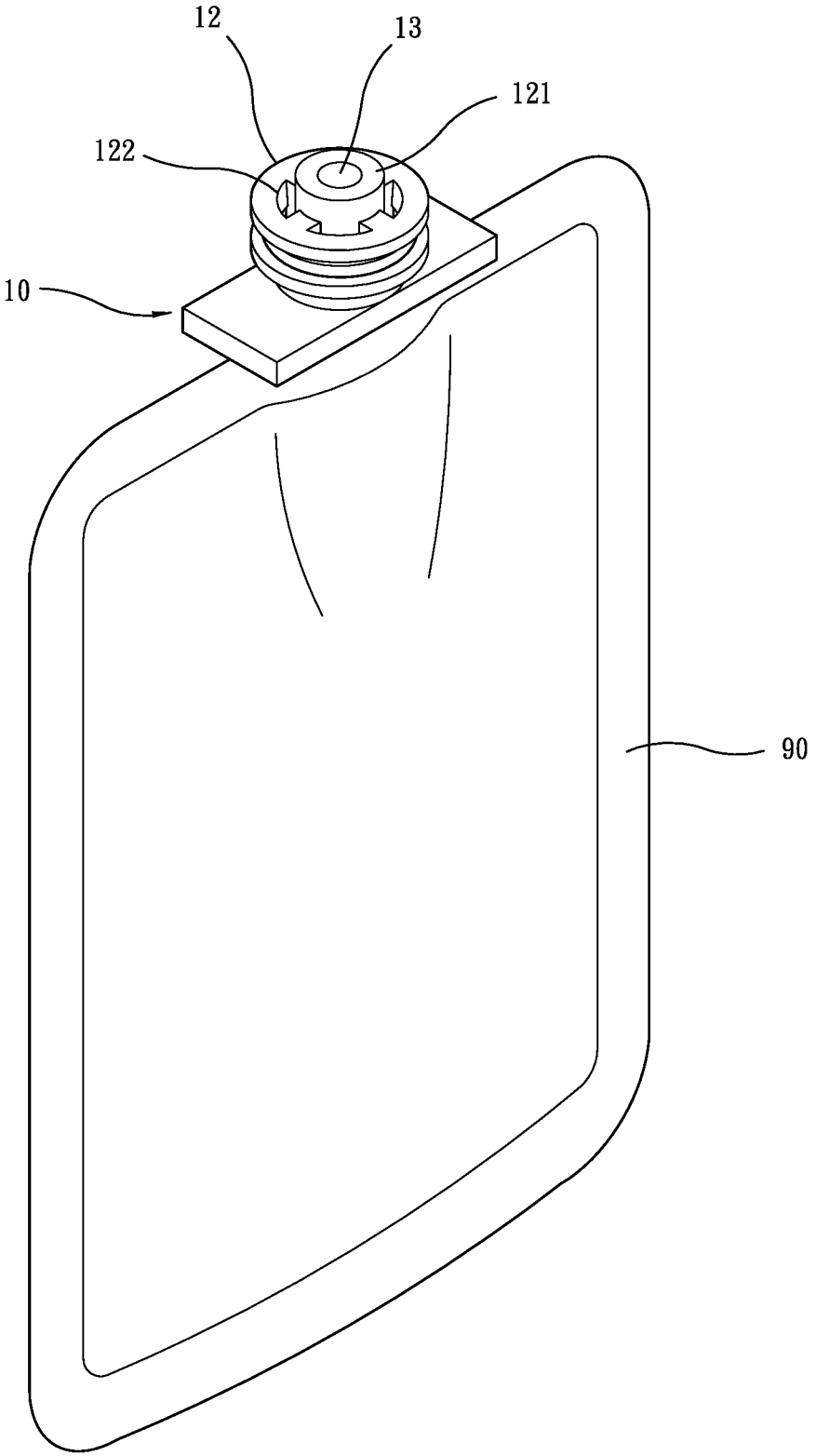
FIGS. 5-8 are schematic views demonstrating operations of the present invention being combined with a pouch body and being filled with ink.
Figure 6:
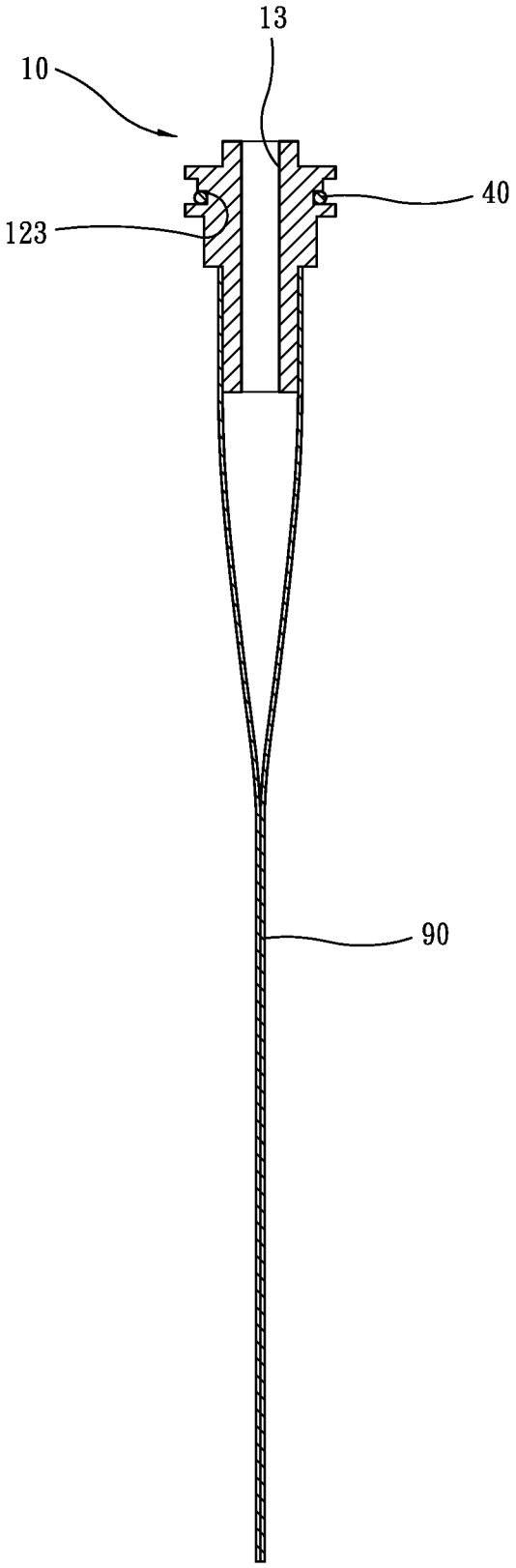
Figure 7:
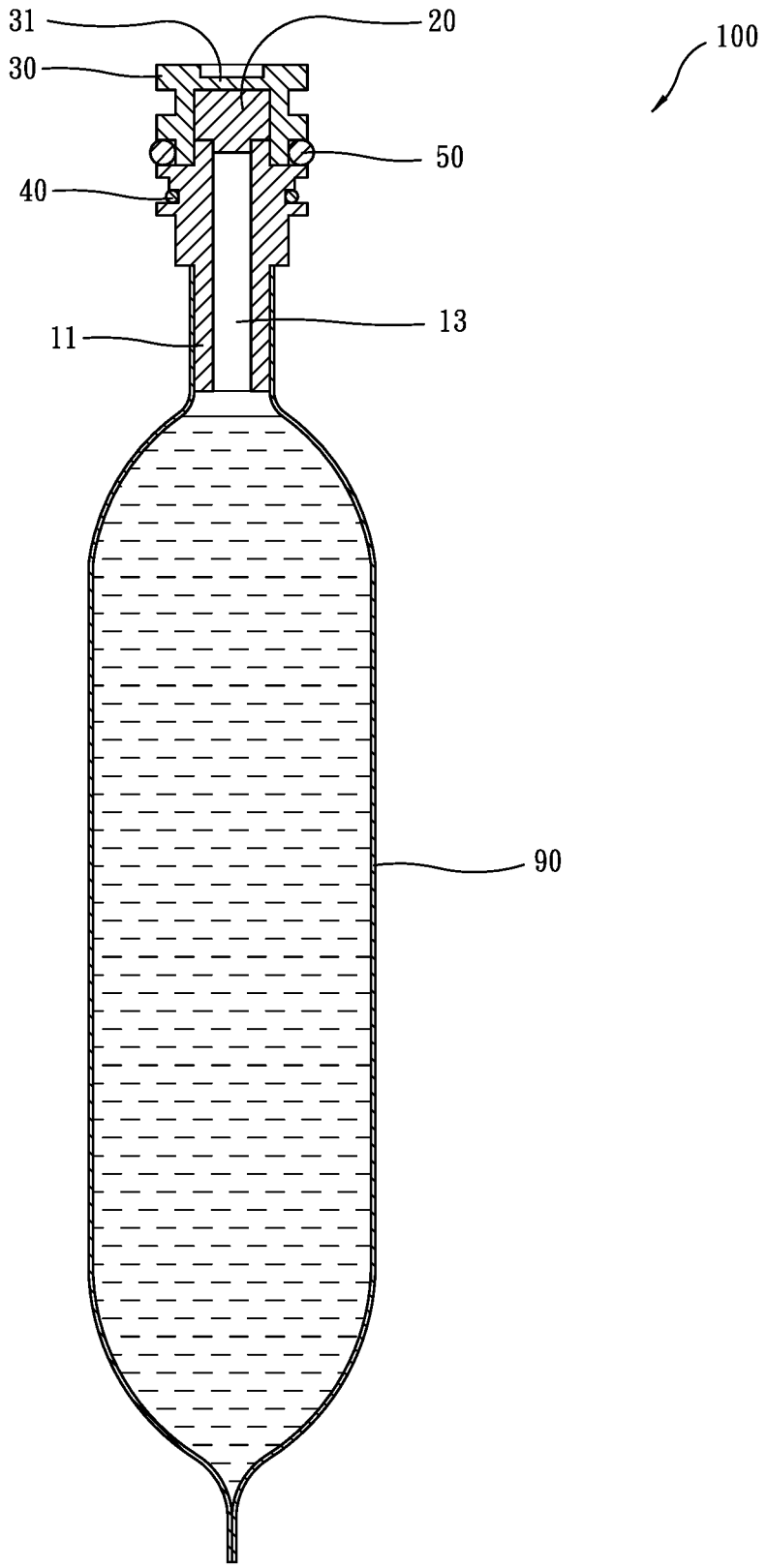
Figure 8:
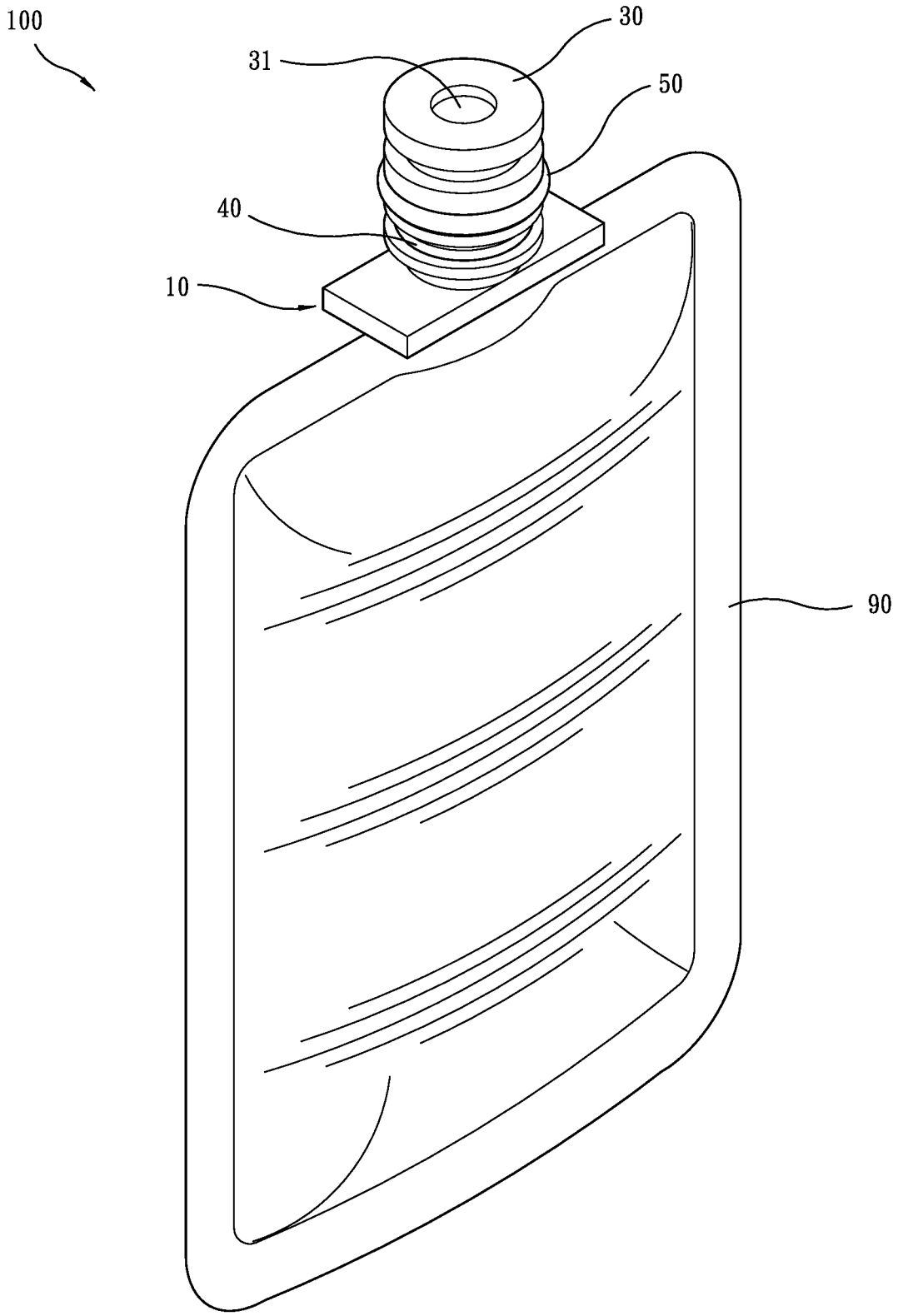

Referring to FIGS. 4-8, an assembling process of the present invention is carried out by first subjecting the joining section 11 of the connector body 10 and a pouch body 90 to high frequency bonding (as shown in FIG. 5), and then, fitting the first sealing ring 40 tightly around and in the annular retaining groove 123 of the connector body 10 (as shown in FIG. 6). Then, a predetermined amount of ink is filled through the ink passage 13 of the connector body 10 into an interior of the pouch body 90 (as shown in FIG. 7), and the flexible plug 20 is then positioned in the fitting trough 32 of the sealing cap 30 and the insertion arms 331 of the engaging and retaining sections 33 of the sealing cap 30 are respectively inserted into the insertion slots 122 of the connector body 10 such that the engaging blocks 332 protrude into the annular retaining groove 123 of the connector body 10 (as shown in FIGS. 4 and 7), and then, the second sealing ring 50 is tightly fit around and in the annular sealing groove 34 of the sealing cap 30 (as shown in FIGS. 4 and 7) to complete assembling of the present invention (as shown in FIG. 8).

The sealing cap 30 and the connector body 10 are joined to each other and combined together, so that the flexible plug 20 is tightly fit, and thus blocked, between the ink passage 13 and the pressing section 31. The fitting peg 121 is fit into or extended into the fitting trough 32 to provide an effect of effectively sealing ink. Further, since the sealing cap 30 is set in engagement with and joined to the connector body 10 by having the engaging blocks 332 retained in the annular retaining groove 123 of the connector body 10, the joining between the two is fixed and secured in a tight way so as to make the connector body 10 and the sealing cap 30 tightly combined with each other to prevent ink from leaking out at interfacing between the connector body 10 and the sealing cap 30. Further, the present invention is also structured to include the first sealing ring 40 and the second sealing ring 50 that are fit at the joining portion between the connector body 10 and the sealing cap 30, meaning the first sealing ring 40 is fit in the annular retaining groove 123 of the connector body 10 to prevent ink from leaking at a site between lower ends of the engaging and retaining sections 33 and the annular retaining groove 123 and the second sealing ring 50 is fit in the annular sealing groove 34 of the sealing cap 30 to prevent ink from leaking at a site between top ends of the engaging and retaining sections 33 and the annular sealing groove 34, so as to achieve a strengthened effect of leaking preventing.

Finally, the present invention is made by first combining the connector body 10 and the pouch body 90, and then ink is filled through the ink passage 13 of the connector body 10 into the interior of the pouch body 90, and finally, the sealing cap 30 is mounted to the connector body 10 for sealing. As such, after ink has been filled in the present invention, there is no need to carry out any high frequency bonding operation and a desired, fixed amount of ink can be achieved for filling and quality variation or deterioration of the ink is prevented. Since all the parts and components of the present invention can be made separately through individual injection molding operations, no process of two-injection over-molding operation is necessary and no purchase and installation of the two-injection molding machinery is needed. Thus, the fabrication is made simple; the cost is lowered; and market competition power is enhanced.

I claim:

1. A connector structure of an ink pouch, comprising:

a connector body, which comprises a joining section, a sealing section joined to the joining section, and an ink passage extending in a longitudinal direction through the joining section and the sealing section, the sealing section having a top surface on which a fitting peg, which is hollow, is formed to extend upward from a circumference of the ink passage, the top surface of the sealing section being formed with a plurality of insertion slots that are extended downward and spaced from each other along a circumference of the fitting peg by a predetermined interval, the sealing section having an external circumferential surface that is partly and inwardly recessed to form an annular retaining groove, the annular retaining groove being in communication with ends of the plurality of the insertion slots;

a sealing cap having a top surface that is partly recessed downward in a central portion thereof to form a pressing section, the sealing cap having a bottom surface that is partly recessed upward to form a fitting trough corresponding in position to the pressing section, the bottom surface of the sealing cap being provided with a plurality of engaging and retaining sections projecting therefrom and along a circumference of the fitting trough and spaced from each other by a predetermined interval, the engaging and retaining sections each comprising an insertion arm extending downward from the bottom surface of the sealing cap and an engaging block protruding outward from an end of the insertion arm; and a flexible plug having an outside diameter that is greater than an inside diameter of the ink passage of the connector body;

wherein to combine, the flexible plug is positioned in the fitting trough of the sealing cap, and the insertion arms of the engaging and retaining sections of the sealing cap are respectively inserted into the insertion slots of the connector body, such that the engaging blocks protrude into the annular retaining groove of the connector body to securely combine the sealing cap and the connector body together, and wherein the fitting peg is located in the fitting trough and the flexible plug closes the ink passage.

2. The connector structure of the ink pouch according to claim 1, wherein the connector body is integrally formed of a material of plastics; the sealing rings are integrally formed of a material of plastics; and the flexible plug is formed of a material that is softer than the materials of the connector body and the sealing rings.

3. The connector structure of the ink pouch according to claim 1, wherein the joining section of the connector body is connectable with a pouch body.

4. The connector structure of the ink pouch according to claim 1, wherein each of the insertion slots of the connector body has a side that is an inclined wall such that a diameter of the insertion slot is gradually reduced in a direction from a top end toward a bottom end.

5. The connector structure of the ink pouch according to claim 1, further comprising a first sealing ring, which is fit around and in the annular retaining groove of the connector body.

6. The connector structure of the ink pouch according to claim 1, further comprising a second sealing ring, wherein the sealing cap is formed with an annular sealing groove in an outer circumferential surface adjacent to the engaging and retaining sections; and the second sealing ring is fit around and in the annular sealing groove of the sealing cap.

* * * * *